US006247544B1

(12) United States Patent
Beebe

(10) Patent No.: US 6,247,544 B1
(45) **Date of Patent: *Jun. 19, 2001**

(54) DUCKBILL WITH CUTTING TEETH

(75) Inventor: Randal M. Beebe, Tracy, IA (US)

(73) Assignee: Vermeer Manufacturing Company, Pella, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/812,789

(22) Filed: Mar. 6, 1997

(51) Int. Cl.[7] ..... E21B 10/42
(52) U.S. Cl. ..... 175/351; 175/398
(58) Field of Search ..... 175/397, 45, 421, 175/345, 348, 351, 398; 37/460, 459

(56) References Cited

U.S. PATENT DOCUMENTS

| | | | | |
|---|---|---|---|---|
| 2,701,126 | * | 2/1955 | McClennan | 175/397 X |
| 2,815,933 | * | 12/1957 | Dionisotti | 175/420.1 X |
| 4,953,638 | | 9/1990 | Dunn . | |
| 5,067,262 | * | 11/1991 | Stiffler et al. | 37/452 |
| 5,148,880 | | 9/1992 | Lee et al. . | |
| 5,242,026 | * | 9/1993 | Deken et al. | 175/62 |
| 5,341,887 | | 8/1994 | Deken et al. . | |
| 5,392,868 | | 2/1995 | Deken et al. . | |
| 5,526,886 | * | 6/1996 | Jenne | 175/45 |
| 5,597,046 | * | 1/1997 | Fisk | 175/45 X |
| 5,647,448 | * | 7/1997 | Skaggs | 175/421 |
| 5,687,807 | | 11/1997 | Woods et al. . | |
| 5,778,991 | | 7/1998 | Runquist et al. . | |
| 5,799,740 | | 9/1998 | Stephenson et al. . | |
| 5,899,283 | | 5/1999 | Cox . | |
| 5,941,322 | | 8/1999 | Stephenson et al. . | |
| 5,950,743 | | 9/1999 | Cox . | |

FOREIGN PATENT DOCUMENTS

WO 97/33065 9/1997 (WO) .

OTHER PUBLICATIONS

Exhibit 1, photo of prior art cutting blade (admitted prior art).
"4th Generation Drill Head Assembly". Straightline Directional Tooling—Training Seminar, 1 p., Jun. 14, 1996.
"Barbco Directional Tooling for All Makes, All Models, All Soil Conditions", Barbco, Inc., 1 p., (undated).

* cited by examiner

*Primary Examiner*—Frank Tsay
(74) *Attorney, Agent, or Firm*—Merchant & Gould P.C.

(57) ABSTRACT

A directing blade for a directional boring machine includes a blade body which extends along a longitudinal axis from an attachment end to a free end. The free end has a plurality of cutting teeth disposed in a non-symmetrical pattern relative to the longitudinal axis. The teeth are progressively spaced from a center portion of the leading end alternating from a first side to a second side of the body of the duckbill blade.

29 Claims, 1 Drawing Sheet

DUCKBILL WITH CUTTING TEETH

I. BACKGROUND OF THE INVENTION

1. Field of the Invention

This invention pertains to directional boring machines. More particularly, this invention pertains to a directional boring machine with a novel duckbill for facilitating penetration of the earth.

2. Description of the Prior Art

Directional boring machines are well known. An example of such a machine is shown in U.S. Pat. No. 4,953,638.

In directional boring machines, a plurality of pipe segments are threadedly interconnected to form a drill string. A terminal end of the drill string is provided with a drill head. An above-ground end of the drill string is rotated and longitudinally advanced by a boring machine. Through manipulation of the boring machine, the drill head can be forced through the earth to form a bore. Drill heads come in a variety of shapes and configurations.

The '638 patent shows a particular design of a drill head which includes a metal plate (item 72 in FIG. 6) attached to a drill head where the metal plate extends forwardly from the drill head. In the industry, such a metal plate is referred to as a duckbill. The duckbill assists in penetrating the earth as the drill string is rotated. Further, the angled inclination of the duckbill relative to the axis of rotation of the drill head encourages the drill string to be moved in a curved direction when the drill head is being longitudinally advanced without rotation.

Underground directional boring machines are used to form bores through a wide variety of soil conditions. Flat duckbills such as that shown in FIG. 6 of the '638 patent are adequate for soft soil conditions. However, such drill heads may not be satisfactory for rock or other hard soil conditions. In such conditions, it would be desirable to provide additional cutting teeth on the duckbill to facilitate cutting through the soil conditions. An example of a duckbill with cutting members is shown in U.S. Pat. No. 5,148,880 in FIGS. 29–31.

II. SUMMARY OF THE INVENTION

According to a preferred embodiment of the present invention, a directing blade for a directional boring machine is disclosed. The directing blade includes a blade body which extends along the longitudinal axis from an attachment end to a free end. The attachment end is attachable to a blade attachment surface of a drill head. The terminal end of the blade body includes a plurality of cutting teeth secured thereto. The teeth are disposed in a non-symmetrical pattern relative to a longitudinal axis of the blade body.

III. BRIEF DESCRIPTION OF THE DRAWINGS

IV. DESCRIPTION OF THE PREFERRED EMBODIMENT

Figure 1:
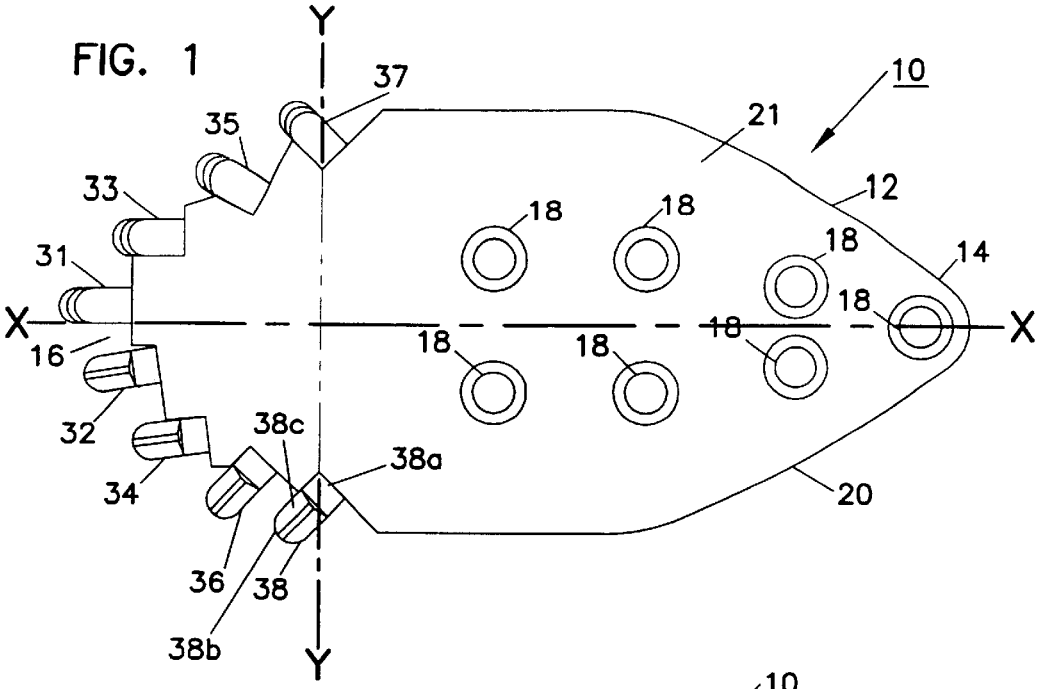
FIG. 1 is a plan view of a duckbill according to the present invention.

Referring now to the drawing figures in which identical elements are numbered identically throughout, a description of the preferred embodiment will now be provided.

The present invention pertains to a duckbill for attachment to a drill head of a directional boring machine. Such drill heads are provided at the terminal end of a rotary drill string. The drill head has a terminal end and a blade attachment surface for attachment of a duckbill. Such directional boring machines and drill heads having attached duckbills are well known in the art. Examples of such are shown in U.S. Pat. Nos. 4,953,638 and 5,148,880 (incorporated herein by reference).

Figure 2:
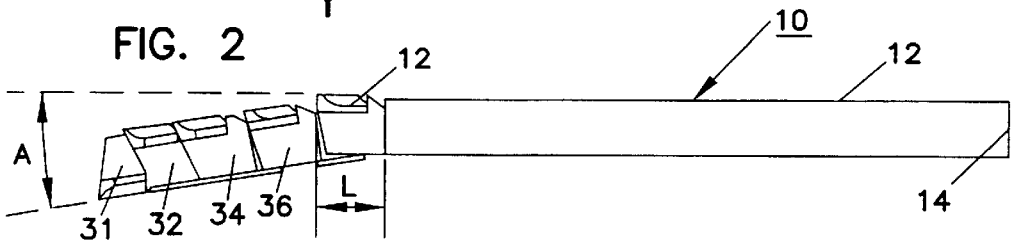
FIG. 2 is a side elevation view of the duckbill of FIG. 1.

In FIGS. 1 and 2, a novel duckbill (which can also be referred to as a directing blade) is shown. The duckbill 10 is formed of steel and includes a duckbill or blade body 12 extending from an attachment end 14 to a free end 16.

The attachment end 14 includes a plurality of bolt holes 18 placed to match a bolt pattern for attachment to an attachment surface of a drill head. For example, FIG. 23 of the aforementioned U.S. Pat. No. 5,148,880 shows a duckbill 372 attached to a surface 392 of a drill head 358 through bolts 382 passed through aligned bolt holes (275, 277, 278 and 279 in FIG. 21).

A longitudinal axis X—X divides the body 12 into a first side 20 and a second side 21.

Figure 3:
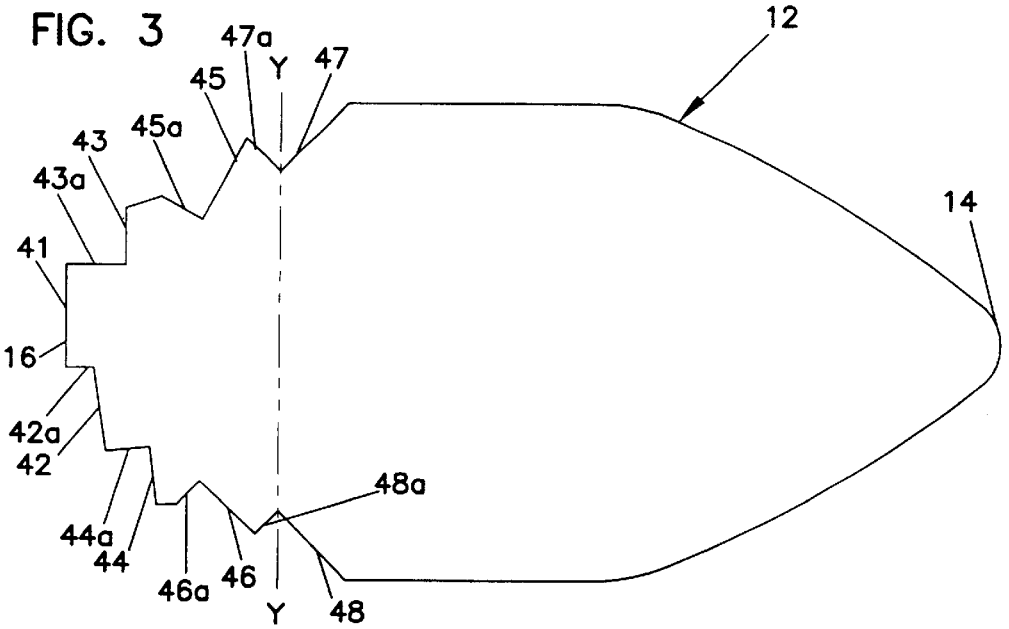
FIG. 3 is the view of FIG. 1 without showing bolt holes or cutting teeth.

A plurality of cutting teeth 31–38 are secured to the free end 16. Specifically, best shown in FIG. 3, the body is provided with a plurality of cutout or attachment locations into which individual cutting teeth may be placed for welding to the free end. The free end 16 is separated from the attachment end 14 by a transverse axis Y—Y. As is conventional, the duckbill is provided with a bend having an angle A of about 90 between the free end and the attachment end.

The free end 16 is provided with a plurality of attachment locations 41–48 for receiving individual ones of the teeth 31–38. Attachment location 41 is at the furthest end of the free end 16 from the attachment end 14. Surface 41 is perpendicular to the axis X—X.

Each of the teeth 31–38 is identical. With reference to tooth 38, the teeth include a longitudinal dimension, L, with one end 38*a* being a squared end and with the opposite end 38*b* being rounded and having carbide cutting tips 38*c* on one side. Examples of such teeth are marketed under the name "Sharktooth" by Consolidated Carbide of Lake Havasu, Ariz., which include carbide cutting tips on steel bodies.

Tooth 31 is secured to edge 41 with the longitudinal axis of the tooth 31 being parallel to but spaced from the longitudinal axis X—X.

Ledge 42 includes a sidewall 42*a* which is perpendicular to edge 42. Sidewall 42*a* is set at an angle relative to axis X—X. Edge 42 spaced rearwardly of ledge 41. Tooth 32 is received with its longitudinal side abutting edge 42*a* such that the axis of cutting tooth 32 is set at the same angle as sidewall 42*a* with respect to axis X—X. Since the edge 42 is recessed relative to the edge 41, the carbide tip of tooth 32 is recessed relative to the carbide tip of tooth 31.

Each of the remaining pockets 43–48 include sidewalls 43*a*–48*a* which are set at 90° relative to the edges 43–48. Further, each of the edges 43–48 is further recessed relative to a preceding recess. For example, edge 43 is recessed relative to recess 42. Edge 44 is recessed relative to recess 43. Edge 45 is further set back with respect and relative to edge 44. Edge 46 is set back relative to edge 45 and edge 47 is set back relative to edge 46 and edge 48 is set back relative to edge 42. As a result, and as a result of the further and progressive angling of the edge, alternate teeth are further recessed relative to tooth 31 in a sequence moving from the left side 21 to the right side 20 and the positioning of the teeth moving subsequently away from the center line X—X. Accordingly, tooth 32 is set back from tooth 31. The cutting tip of tooth 33 is set back from tooth 32. The cutting tip of tooth 34 is set back relative to tooth 33. The cutting tip of tooth 35 is set back from tooth 34. The cutting tip of tooth 36 is set back from the tip of tooth 35. The cutting tip of tooth 37 is set back from tooth 36 and the cutting tip of tooth 38 is set back from tooth 37. The cutting tips of teeth on the first side 20 are set on opposite sides than the cutting tips of teeth on side 21. This is recognition that the head or blade will rotate about axis X—X during use such that the cutting teeth should be on opposite sides of axis X—X.

By placing the cutting teeth at staggered positions relative to one another in a non-symmetrical pattern relative to X—X, each of the cutting teeth 31–38 will cut an individual arc. Further, with the sequence shown, the cutting teeth will cut individual circles where the circles of all the cutting teeth will form concentric circles about the bore axis being formed by the blade. Accordingly, most efficient cutting is achieved by not requiring redundant cutting from each of the teeth.

Having disclosed the invention in the preferred embodiment, it will be appreciated that modifications and equivalents of the disclosed concepts are intended to be included within the scope of the claims which are appended hereto.

I claim:

1. A directing blade for a directional boring machine, said blade comprising:

a blade body extending along a longitudinal axis from an attachment end to a free end, said blade body being non-symmetrical with respect to said longitudinal axis, said attachment end being adapted for connection to a drill head of the directional boring machine;

said free end having a plurality of cutting teeth secured thereto with said teeth disposed in a non-symmetrical pattern relative to said longitudinal axis, wherein a first angle between a first tooth and the longitudinal axis is at least equal to a second angle of a second tooth closer to the free end.

2. A blade according to claim 1 wherein said free end includes a center portion at said axis with said axis separating said blade body into a first side and a second side;

said cutting teeth secured to said free end for said pattern to have said teeth progressively spaced from said center portion from said longitudinal axis and alternating from said first side to said second side.

3. A blade according to claim 1 wherein said teeth are provided with cutting tips on said teeth.

4. A blade according to claim 3 wherein said tips are on a first side of teeth of said first side and on a second side of teeth of said second side.

5. A blade according to claim 1 wherein said pattern is selected for each of said teeth to cut a path separate from a path of any of said other teeth as the directing blade is rotated about said axis.

6. A directing blade for a directional boring machine, said blade comprising:

a blade body extending along a longitudinal axis from an attachment end to a free end, said attachment end being adapted for connection to a drill head of the directional boring machine;

a plurality of edges at the free end of the blade body, said edges being formed in a non-symmetrical pattern with respect to said longitudinal axis; and a plurality of cutting teeth secured in pockets formed by the edges.

7. A directing blade according to claim 6, wherein said free end includes a center portion at the longitudinal axis.

8. A directing blade according to claim 7, wherein said longitudinal axis divides said blade body into a first side and a second side, and wherein said non-symmetrical pattern includes said teeth being spaced progressively further from said longitudinal axis and alternating from said first side to said second side, in a direction from said center portion toward said attachment portion.

9. A blade for a directional boring machine, the blade comprising:

a blade body extending along a central longitudinal reference axis from a front end to a rear, attachment end, the reference axis dividing the blade body into first and second portions;

a plurality of cutting teeth positioned at the front end of the blade body, the cutting teeth including:

a first tooth mounted at the first portion of the blade body;

a second tooth mounted at the second portion of the blade body, the second tooth being spaced farther from the reference axis than the first tooth and also being set back further than the first tooth; and a third tooth mounted next to the first tooth at the first portion of the blade body, the third Tooth being spaced further from the reference axis than the second tooth and also being set back further than the second tooth.

10. The blade of claim 9, further comprising a fourth tooth mounted at the second portion of the blade body, the fourth tooth being spaced farther from the reference axis than the third tooth and being set back further than the third tooth.

11. The blade of claim 9, wherein the first tooth is mounted at the reference axis.

12. The blade of claim 11, wherein the first tooth is not angled relative to the reference axis.

13. The blade of claim 11, further comprising a fifth tooth mounted next to the third tooth at the first portion of the blade body, the fifth tooth being spaced further from the reference line than the fourth tooth and also being set back further than the fourth tooth.

14. The blade of claim 13, further comprising a sixth tooth mounted next to the fourth tooth at the second portion of the blade body, the sixth tooth being set back at least as far as the fifth tooth.

15. The blade of claim 14, further comprising a seventh tooth mounted next to the fifth tooth on the first portion of the blade body, the seventh tooth being set back further than both the fifth and sixth teeth.

16. The blade of claim 15, further comprising an eighth tooth mounted next to the sixth tooth on the second portion of the blade body, the eighth tooth being set back at least as far as the seventh tooth.

17. The blade of claim 16, wherein the first and third teeth are not angled relative to the reference axis; and the second, fourth, fifth, sixth, seventh and eighth teeth are angled relative to that reference axis.

18. The blade of claim 17, wherein the fifth, sixth, seventh, and eighth teeth are set at greater angles relative to the reference axis than the second and fourth teeth.

19. The blade of claim 9, wherein the first, second and third teeth are forwardly facing teeth.

20. The blade of claim 19, wherein the blade body comprises a plate.

21. The blade of claim 20, wherein the plate is bent adjacent the front end.

22. The blade of claim 20, wherein at least some of the forwardly facing teeth are angled relative to the reference axis.

23. The blade of claim 22, wherein the blade body defines pockets in which the cutting teeth are mounted.

24. The blade of claim 23, wherein the pockets comprise open notches.

25. The blade of claim 24, wherein the notches are defined between discrete edges.

26. The blade of claim 9, wherein the blade body defines pockets in which the cutting teeth are mounted.

27. The blade of claim 26, wherein the pockets include open notches.

28. The blade of claim 26, further comprising teeth mounted at the first, second and third notches.

29. A blade for a directional boring machine, the blade comprising:

a blade body extending along a central longitudinal reference axis from a front end to a rear, attachment end, the reference axis dividing the blade body into first and second portions;

a plurality of notches positioned at the front end of the blade body for mounting cutting teeth, the notches including:

a first notch positioned at the first portion of the blade body;

a second notch at the second portion of the blade body, the second notch being spaced farther from the reference axis than the first notch and also beings set back further than the first notch; and a third notch located next to the first notch at the first portion of the blade body, the third notch being spaced farther from the reference axis than the second notch and also being set back further than the second notch.

* * * * *